US008344236B2

(12) United States Patent
Mayes

(10) Patent No.: US 8,344,236 B2
(45) Date of Patent: Jan. 1, 2013

(54) POLYPHONIC GUITAR PICKUP

(76) Inventor: Adam Eugene Mayes, Tulsa, OK (US)

( * ) Notice: Subject to any disclaimer, the term of this patent is extended or adjusted under 35 U.S.C. 154(b) by 0 days.

(21) Appl. No.: 12/939,877

(22) Filed: Nov. 4, 2010

(65) Prior Publication Data

US 2011/0100200 A1 May 5, 2011

Related U.S. Application Data

(60) Provisional application No. 61/257,946, filed on Nov. 4, 2009.

(51) Int. Cl.
*G10H 3/18* (2006.01)

(52) U.S. Cl. ..... 84/726; 84/727; 84/728

(58) Field of Classification Search ..... 84/725–729
See application file for complete search history.

(56) References Cited

U.S. PATENT DOCUMENTS

| | | | | | |
|---|---|---|---|---|---|
| 2,892,371 | A * | 6/1959 | Butts | 84/727 |
| 2,911,871 | A * | 11/1959 | Schultz | 84/725 |
| 2,964,985 | A * | 12/1960 | Webster | 84/723 |
| 3,177,283 | A * | 4/1965 | Fender | 84/726 |
| 3,249,677 | A * | 5/1966 | Burns et al. | 84/726 |
| 3,524,008 | A * | 8/1970 | Scherer et al. | 84/729 |
| 3,711,619 | A * | 1/1973 | Jones et al. | 84/726 |
| 3,983,778 | A * | 10/1976 | Bartolini | 84/726 |
| 4,051,761 | A * | 10/1977 | Nylen | 84/726 |
| 4,624,172 | A * | 11/1986 | McDougall | 84/726 |
| 4,686,881 | A * | 8/1987 | Fender | 84/727 |
| 4,995,292 | A * | 2/1991 | Nomura | 84/726 |
| 5,070,759 | A * | 12/1991 | Hoover et al. | 84/726 |
| 5,335,576 | A * | 8/1994 | Hayashi | 84/727 |
| 5,376,754 | A * | 12/1994 | Stich | 84/728 |
| 5,389,731 | A * | 2/1995 | Lace | 84/726 |
| 5,399,802 | A * | 3/1995 | Blucher | 84/726 |
| 5,525,750 | A * | 6/1996 | Beller | 84/726 |
| 5,894,101 | A * | 4/1999 | Damm | 84/728 |
| 5,932,827 | A * | 8/1999 | Osborne et al. | 84/726 |
| 6,372,976 | B2 * | 4/2002 | Damm | 84/723 |
| 7,115,809 | B2 * | 10/2006 | Kavanaugh | 84/726 |
| 7,166,794 | B2 * | 1/2007 | Juszkiewicz et al. | 84/728 |
| 7,244,886 | B2 * | 7/2007 | Hosler | 84/726 |
| 7,285,714 | B2 * | 10/2007 | Juszkiewicz et al. | 84/726 |
| 7,952,014 | B2 * | 5/2011 | Juszkiewicz et al. | 84/742 |
| 7,989,690 | B1 * | 8/2011 | Lawing | 84/726 |
| 2005/0028669 | A1 * | 2/2005 | Kavanaugh | 84/726 |
| 2007/0056435 | A1 * | 3/2007 | Juszkiewicz et al. | 84/726 |
| 2010/0101399 | A1 * | 4/2010 | Calvet | 84/726 |
| 2010/0122623 | A1 * | 5/2010 | Salo | 84/726 |
| 2011/0100200 | A1 * | 5/2011 | Mayes | 84/726 |

* cited by examiner

*Primary Examiner* — David S. Warren

(57) ABSTRACT

A guitar pickup for use with an electric guitar may comprise a base, a plurality of magnets operably coupled to the base, and a plurality of bobbins situated on the plurality of magnets. The plurality of bobbins may each have a pole slug within its interior and may each have a wire coiled around its shaft. One or more of the plurality of magnets may be able to induce a change in magnetic flux in the pole slug in response to vibrations of a guitar string of the electric guitar.

9 Claims, 2 Drawing Sheets

POLYPHONIC GUITAR PICKUP

CROSS-REFERENCE TO RELATED APPLICATIONS

This application claims the benefit of priority to U.S. provisional patent application No. 61/257,946 filed Nov. 4, 2009, which is incorporated herein by reference.

BACKGROUND OF THE INVENTION

The present invention generally relates to electric guitar accessories, and more specifically relates to a polyphonic guitar pickup.

SUMMARY OF THE INVENTION

In one aspect of the present invention, a guitar pickup for use with an electric guitar comprises a base; a plurality of magnets operably coupled to the base; and a plurality of bobbins situated on the plurality of magnets, the plurality of bobbins each having a pole slug within its interior and each having a wire coiled around its shaft; wherein one or more of the plurality of magnets is operable to induce a change in magnetic flux in the pole slug in response to vibrations of a guitar string of the electric guitar.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide for a polyphonic guitar pickup for use with electric guitars. By having a low resistance compared with other pickups, such as having a resistance range of below about 3.5 k ohms and as low as 2.9 k ohms, while still providing more volume, the guitar pickup may provide for greater frequency response than conventional one-coil pickups without bleeding off high, treble, or low bass sounds while allowing the sound of each coil for the treble, mid, and high strings of electric guitars to be customized. Thus, the guitar pickup may provide a wider range of tonal possibilities for electric guitars than is possible with conventional one-coil pickups.

Figure 1:
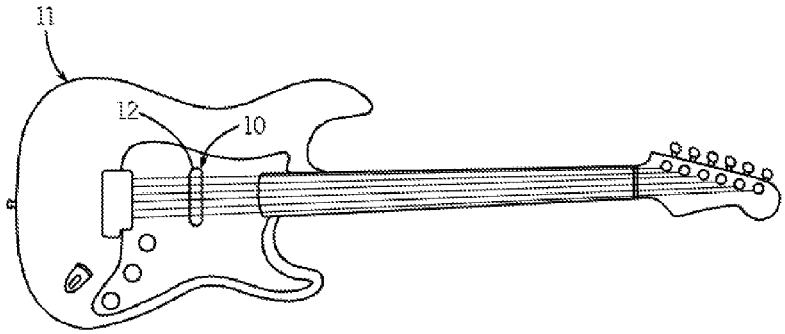
FIG. 1 shows a front elevation view of a guitar pickup in use with an electric guitar in accordance with an embodiment of the present invention.

As shown in FIG. 1, a guitar pickup 10 may be attached to an electric guitar 11 in a similar fashion as a standard single coil pickup to pick up vibrations from the steel strings of the electric guitar 11 when the electric guitar is being played. A cover 12 may be made to fit a unique geometry of the components of the guitar pickup 10 and may help to protect the guitar pickup 10 from damage.

Figure 2:
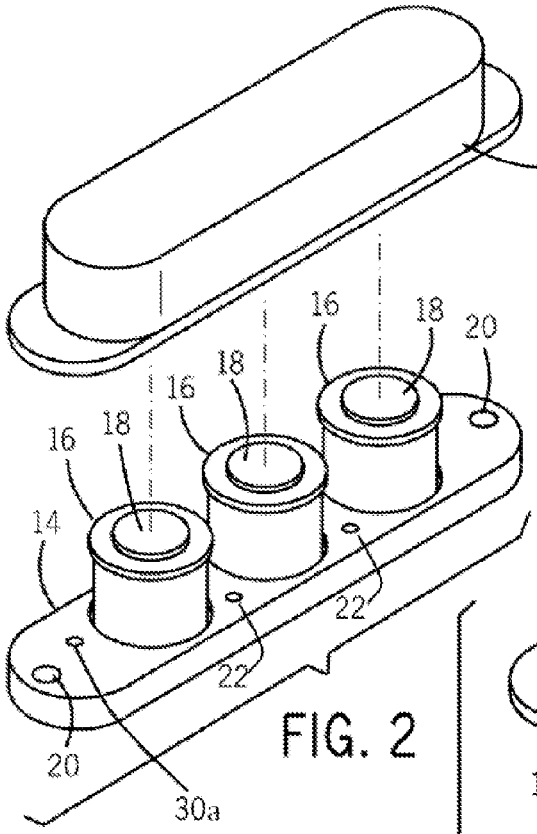
FIG. 2 shows an exploded perspective view of the guitar pickup of FIG. 1.
Figure 3:
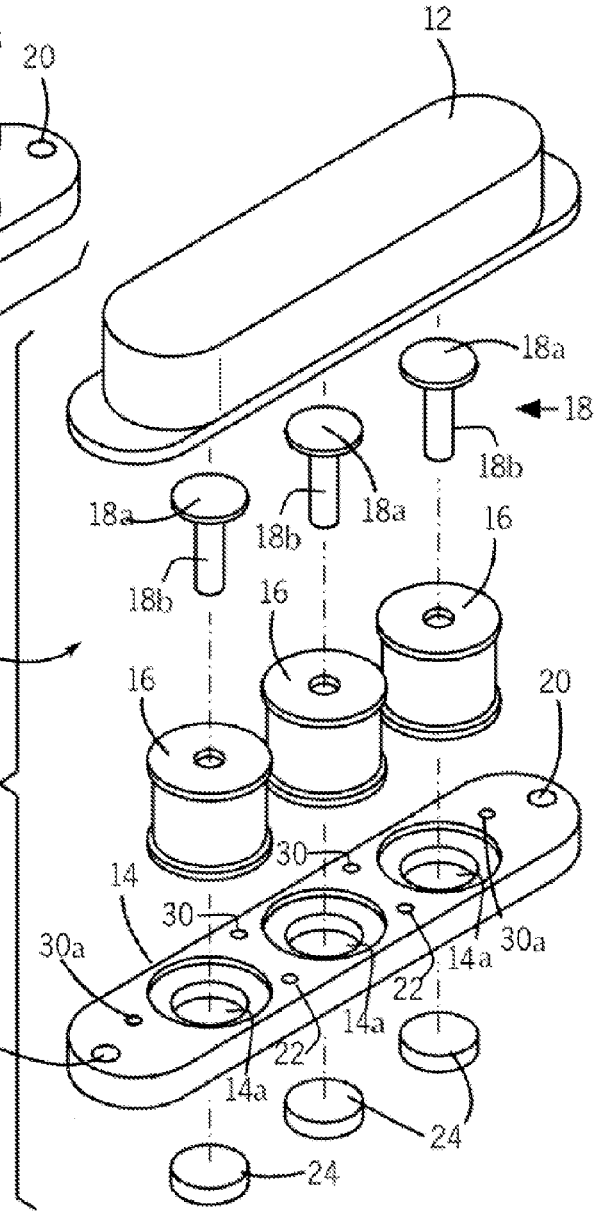
FIG. 3 shows a second exploded perspective view of the guitar pickup of FIG. 1.

As shown in FIGS. 2 and 3, the guitar pickup 10 may include three bobbins 16 that may sit on a base plate 14 and may be wired in series or in parallel. Although the guitar pickup 10 may comprise any number of bobbins 16, generally there may be at least three and no more than six bobbins 16 on a single guitar pickup 10. The bobbins 16 may be made of acrylic, but may also be made of any non-conductive material (or insulated conductive material) of sufficient strength. The bobbins 16 may also be spaced so that when used in conjunction with the electrical guitar the bobbins 16 may generally be disposed between the two bass (i.e. E and A), two mid (i.e. D and G), and two treble (i.e. B and high E) strings of the electrical guitar 11.

Each of the bobbins 16 may be coiled with wire 28, such as copper wire. A separate wire 28 may wrap around each bobbin 16 on the electrical guitar pickup 10. The wires 28 may be wrapped for several thousand turns around each of the bobbins 16. The number of turns may range from about 5,000 to 9,000 turns, and more specifically may be about 7,000 turns. The number of turns around each bobbin 16 may be different. For example, in a three-bobbin 16 electric guitar pickup 10, a first bobbin 16 to be disposed between two treble strings of the electrical guitar 11 may have about 6,000 turns of wire 28 wrapped around its shaft, a second bobbin 16 to be disposed between the two mid strings of the electrical guitar 11 may have about 7,750 turns of wire 28 coiled around its shaft, and a third bobbin 16 to be disposed between the two bass strings of the electrical guitar 11 may have about 6,800 turns of wire 28 coiled around its shaft. The wire 28 wrapped around each of the bobbins 16 may connect with one another at solder points 30 to connect the bobbins 16 in series. Alternatively, the wires 28 may connect with one another to connect the bobbins 16 in parallel, or a combination of series and parallel.

The wires 28 may be any insulated gauge wire having a gauge from about 38 to 44 American wire gauge (AWG), or about 42 AWG. Depending on the desired sound, the bobbins 16 may each be wound with a different number of turns using a different-gauged wire 28.

Magnets 24 may be operably coupled to the base plate 14 beneath each of the bobbins 16. The magnets 24 may be pressed into recesses 14*a* on the base plate 14, and may be oriented so that like poles of the magnets 24 may face the same direction. The magnets 24 may be spaced based on the spacing of the strings of the electric guitar 11. In general, a spacing of 0.78 inches may be sufficient, but the specific guitar used may determine the spacing. The force of the magnets 24 may attract the pole slugs 18 within the bobbins 16 to cause the bobbins 16 to be secured on top of the magnets 24. The magnets 24 may be neodymium magnets or may be any magnetic material of sufficient strength. Magnets 24 of varying strengths may be used in a single guitar pickup 10 in order to offer differing magnetic strengths to pole faces 18*a* of varying sizes and shapes.

The magnets 24 may be used to induce an appropriate level of magnetic flux on the pole slug 18 and bobbin 16 sitting on top of each of the magnets 24 to translate the mechanical energy of a guitar string on the electric guitar 11 to an electric current. When the guitar strings vibrate, the magnets 24 may induce a magnetic field in the bobbins 16. The magnetic field may cause pole slugs 18 running within the bobbins 16 to change in magnetic flux and thereby transfer mechanical energy from the string vibrations in an alternating current that may be used by a guitar amplifier or some other suitable apparatus.

The bobbins 16 may each have a pole slug 18 running within the bobbins 16 from the bottom to the top that may act as the soft iron cores for the wire-wrapped 28 bobbins 16. The pole slugs 18 may each comprise a disc-shaped pole face 18*a* near a top face of the bobbins 16 and a pole shaft 18*b*, where the pole face 18*a* may have a greater diameter than the pole shaft 18*b*.

When in use, the pole faces 18*a* may be positioned perpendicularly to the strings of the electric guitar 11. The pole faces 18*a* may be unique for each bobbin 16. For example, pole faces 18*a* on a guitar pickup 10 may each be a round or an oblong shape having varying widths and shapes. For example, in a three-bobbin 16 guitar pickup 10, the pole faces 18*a* of the pole slugs 18 within the three bobbins 16 may be 0.375", 0.275", and 0.175" in diameter, while each of the respective pole shafts 18*b* may be 0.145" in diameter, respectively, although the pole faces 18*a* of the pole slugs 18 may be of any suitable width and shape depending on the desired sound. The geometry of the pole faces 18*a* may be crucial to the sound produced. A wider pole face 18*a* along the length of a guitar string may produce a clearer bass sound while a narrower pole face 18*a* may produce a clearer treble sound.

The base plate 14 of the guitar pickup 10 may generally be as long and wide as a standard single coil pickup. Holes may be drilled or milled into the base plate 14 to allow for soldering points, wiring, and screw clearances. The base plate 14 may comprise recesses 14*a* that may accept the magnets 24 into the base plate 14 and that may also accept the bobbins 16 above each of the magnets 24. Mounting holes 20 and wire holes 22 may be usable to help mount the guitar pickup 10 to the electric guitar 11.

Figure 4:
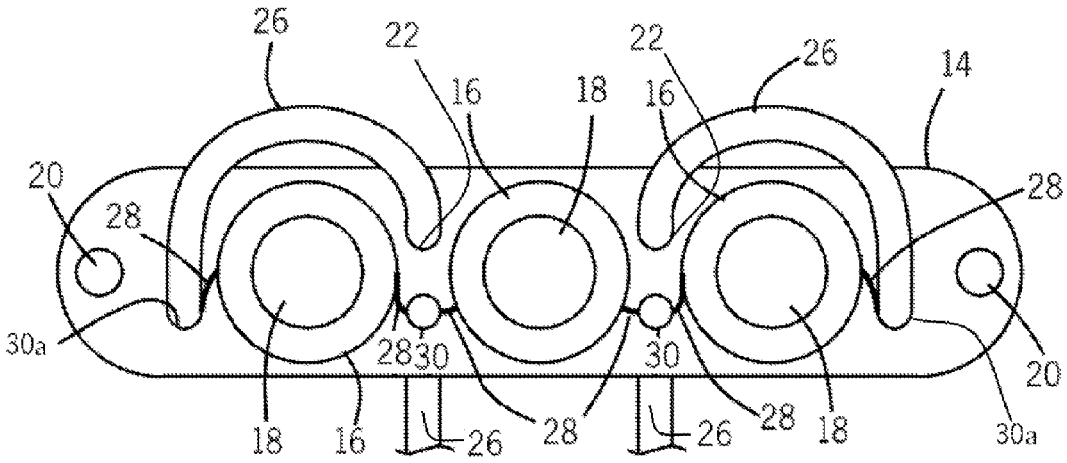
FIG. 4 shows a front elevation view of the guitar pickup of FIG. 1.

As shown in FIG. 4, the wire 28 may be soldered to the base plate 14 at solder points 30, so that a wire 28 wrapped around one bobbin 16 may be connected to another wire 28 wrapped around another bobbin 16 at the solder points 30. A connecting wire 26 may connect to ends of one or more of the wires 28 wrapped around the bobbins 16, such as by soldering, at outer solder points 30*a*, and may be fed through wire holes 22 to connect to amplification or recording equipment for sending signals from the guitar pickup 10. The connecting wires 26 may be any suitable wire and may have a gauge of about 22 AWG.

It should be understood, of course, that the foregoing relates to exemplary embodiments of the invention and that modifications may be made without departing from the spirit and scope of the invention as set forth in the following claims.

I claim:

1. A pickup for use with an electrical stringed musical instrument, comprising:

a base;

a plurality of magnets of a specified strength operably coupled to the base;

a plurality of bobbins situated on the plurality of magnets, each bobbin associated with a single magnet and disposed under each adjacent pair of strings, the plurality of bobbins each having a single pole slug within its interior and each having a wire coiled in a specified number of turns;

each pole slug comprising a pole face having a specified size and shape and a pole shaft, wherein the pole shaft is of a smaller diameter than the pole face, wherein the strength of each magnet, the specified number of turns, and the size and shape of each pole face is selected to provide an optimized frequency response for each pair of strings, and wherein one or more of the plurality of magnets is operable to induce a change in magnetic flux in the pole slug in response to vibrations of a string of the electrical stringed musical instrument.

2. The pickup of claim 1, wherein the plurality of bobbins comprise three to six bobbins.

3. The pickup of claim 1, wherein the plurality of bobbins are wired in series.

4. The pickup of claim 2, wherein:

the pole slug comprises a disc-shaped pole face.

5. The pickup of claim 4, wherein:

a first bobbin within the three bobbins includes a first pole slug having a first disc-shaped pole face with a first width; and a second bobbin within the three bobbins includes a second pole slug having a second disc-shaped pole face with a second width that is different from the first width.

6. The pickup of claim 2, wherein:

a first bobbin within the three bobbins has a first wire coiled around its shaft for a first number of turns; and a second bobbin within the three bobbins has a second wire coiled around its shaft for a second number of turns that is different than the first number of turns.

7. The pickup of claim 6, wherein the first number of turns and the second number of turns are between 5,000 and 9,000 turns.

8. The pickup of claim 1, wherein the pickup has a resistance of below about 3.5 kilohms.

9. The pickup of claim 4, wherein the pole face is of an oblong shape.

* * * * *